US010501871B2

(12) United States Patent
Christopher et al.

(10) Patent No.: US 10,501,871 B2
(45) Date of Patent: Dec. 10, 2019

(54) METHOD FOR PRODUCTION OF MAN-MADE TEXTILE YARNS FROM WOOD FIBERS

(71) Applicant: Lakehead University, Thunder Bay (CA)

(72) Inventors: Lew Christopher, Thunder Bay (CA); MD Nur Alam, Thunder Bay (CA)

(73) Assignee: LAKEHEAD UNIVERSITY, Thunder Bay, Ontario (CA)

( * ) Notice: Subject to any disclaimer, the term of this patent is extended or adjusted under 35 U.S.C. 154(b) by 169 days.

(21) Appl. No.: 15/713,968

(22) Filed: Sep. 25, 2017

(65) Prior Publication Data

US 2018/0127898 A1 May 10, 2018

Related U.S. Application Data

(60) Provisional application No. 62/400,828, filed on Sep. 28, 2016.

(51) Int. Cl.
*D02G 3/02* (2006.01)
*D02G 3/08* (2006.01)

(52) U.S. Cl.
CPC ..... *D02G 3/02* (2013.01)

(58) Field of Classification Search
CPC .. D02G 3/00; D02G 3/02; D02G 3/04; D02G 3/042; D02G 3/08
See application file for complete search history.

(56) References Cited

U.S. PATENT DOCUMENTS

| | | | | |
|---|---|---|---|---|
| 2,087,263 | A * | 7/1937 | Olsen | C08B 1/02 162/85 |
| 2,362,217 | A * | 11/1944 | Schlosser | D01F 2/08 106/166.5 |
| 3,084,021 | A * | 4/1963 | Morimoto | D01F 2/10 264/195 |
| 8,092,732 | B2 * | 1/2012 | Chou | C08B 37/003 264/176.1 |
| 2003/0131962 | A1 * | 7/2003 | Lindsay | D21H 21/18 162/168.2 |
| 2003/0135939 | A1 * | 7/2003 | Sun | D06M 15/285 8/518 |
| 2015/0147558 | A1 * | 5/2015 | Dao | A61L 15/28 428/221 |

* cited by examiner

*Primary Examiner* — Ismael Izaguirre
(74) *Attorney, Agent, or Firm* — Michael R. Williams; Ryan W. Dupuis; Ade + Company Inc.

(57) ABSTRACT

We have developed an environmentally-friendly new process for producing textile yarns. The process involves chemical modification of cellulose with subsequent dissolution of the chemically modified cellulose with chitosan or other amine group-containing compounds which yields a highly viscous gel. The chemical modification of cellulose employs a known process of periodate oxidation which we have modified to obtain fibers with a low degree of aldehyde groups (~2 mmol/g cellulose) that still remain insoluble in water. After washing, the chemically modified fibers can be cross-linked with chitosan or other amine group-containing compounds to produce the viscous gel. The viscous gel can then be extruded through a syringe nozzle in the form of textile yarns.

12 Claims, No Drawings

METHOD FOR PRODUCTION OF MAN-MADE TEXTILE YARNS FROM WOOD FIBERS

PRIOR APPLICATION INFORMATION

The instant application claims the benefit of U.S. Provisional Patent Application Ser. No. 62/400,828, filed Sep. 28, 2016, entitled "METHOD FOR PRODUCTION OF MAN-MADE TEXTILE YARNS FROM WOOD FIBERS", now abandoned, the contents of which are incorporated herein by reference.

BACKGROUND OF THE INVENTION

Natural fibers play an important role in the textile industry. Cotton and wool fibers have always dominated the markets, but in recent years regenerated cellulose fibers have begun to experience renaissance d. Rayon—the main representative of the regenerated cellulose fibers—is produced at an annual rate of 3.7 million metric tonnes. The rayon process is based on the dissolution of cellulose in highly toxic carbon disulphide ($CS_2$) which is the main reason why rayon manufacturing was banned in North America and Europe.

SUMMARY OF THE INVENTION

Most textile years (rayon/viscose, Lyocell/Tencel, cuprammonium cellulose, and the like) are produced from chemically modified or non-modified dissolving pulps, which are first dissolved in a solvent, and then spun into regenerated cellulosic fibers.

In the present invention, we have developed an aqueous-based, non-toxic process to produce textile yarns without a prior dissolution of the cellulosic material in solvents using a wet-spinning process that does not require cellulose regeneration.

The advantages of our invention pertains to:

Spinning of textile fibres directly from a dope made of low-substitution dialdehyde cellulose (degree of substitution between 0.1-0.5) with amine group-containing compounds like chitosan (5-7 wt % of cellulose).

A "green" process that eliminates the need for toxic carbon disulfide solvent used in rayon production Novel textile yarns that have water retention value of up to 2 g water/g yarn which is comparable to cotton yarns.

The chemicals used for chemical modification of cellulose are readily available and inexpensive, and can be regenerated and recycled on-site.

Compared to existing processes for textile yarn production, our method does not require: 1) prior dissolution of cellulosic material in a solvent; and 2) regeneration of the cellulosic fibers during the spinning processes.

The method of generating a textile yarn comprises of the following three major processing steps:

1) Producing dialdehyde cellulose by periodate oxidation of cellulosic fibers;

2) cross-linking dialdehyde cellulose with an amine-containing compound;

3) extruding the cross-linked dialdehyde cellulose gel into textile yarn

According to an aspect of the invention, there is provided method of generating a textile yarn comprising:

subjecting a quantity of wood pulp to periodate oxidation;

recovering dialdehyde cellulose;

dissolving the dialdehyde cellulose in sodium hydroxide;

adding an amine-containing compound to the dissolved dialdehyde cellulose;

recovering a cellulose gel;

filtering the cellulose gel;

extruding the filtered cellulose gel into yarn under acidic conditions; and washing the yarn.

DESCRIPTION OF THE PREFERRED EMBODIMENTS

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are now described. All publications mentioned hereunder are incorporated herein by reference.

To eliminate the toxicity problem associated with rayon production, we have developed an environmentally-friendly new process for producing textile yarns. The process involves chemical modification of cellulose with subsequent dissolution of the chemically modified cellulose with chitosan which yields a highly viscous gel, also referred to herein as dope. The chemical modification of cellulose employs a known process of periodate oxidation which we have modified to obtain fibers with a low degree of aldehyde groups (~2 mmol/g cellulose) that still remain insoluble in water, as discussed below. After washing, the chemically modified fibers can be dissolved in sodium hydroxide and chitosan to produce dope. The dope can then be extruded through a syringe nozzle and cellulose can be regenerated in the form of textile yarns, as discussed below.

Rayon producers use high-purity cellulose pulp (known as dissolving pulp). Our process can use conventional kraft pulp (both softwood and hardwood). The major benefits are: 1) the production cost per ton of bleached kraft pulp are lower than those of dissolving pulp (range can be up to 70% lower costs); and 2) conventional kraft pulps contain a substantial amount of hemicellulose (range 12-20 wt %) whereas hemicellulose in dissolving pulps is almost completely removed as hemicellulose interferes in the rayon manufacturing process. Thus, this provides a significant yield advantage of our process.

According to an aspect of the invention, there is provided a method of generating a textile yarn comprising:

subjecting a quantity of wood pulp to periodate oxidation;

recovering dialdehyde cellulose;

dissolving the dialdehyde cellulose in sodium hydroxide;

adding chitosan to the dissolved dialdehyde cellulose;

recovering a cellulose gel;

filtering the cellulose gel;

extruding the filtered cellulose gel into yarn under acidic conditions; and washing the yarn.

The method of generating a textile yarn comprises the following three major processing steps:

1) producing dialdehyde cellulose by periodate oxidation of cellulosic fibers;

2) cross-linking dialdehyde cellulose with an amine-containing compound;

3) extruding the cross-linked dialdehyde cellulose gel into a textile yarn

Preferably, the wood pulp is a bleached kraftwood pulp, for example a softwood pulp or a hardwood pulp.

The periodate oxidation is used to produce dialdehyde cellulose (DAC) with a degree of substitution of 0.1 to 0.5. For example, a 0.5-1.5 wt % of the periodate solution may be used.

In some embodiments, the NaOH concentration range is 5-20 wt %, preferably 8-10 wt %.

In some embodiments, the DAC concentration is in the range of 5 to 12 w/w %, preferably 8-10 w/w %.

In some embodiments, the concentration of the amine-containing compound for cross-linking such as chitosan is 1-15 wt % of cellulose, preferably 5-7 wt %. As will be appreciated by one of skill the art, the chitosan provides functional amine groups for the reaction. As such, "chitosan" is in effect being used generically herein as any other suitable molecule that will provide functional amine groups to be used within the invention.

In some embodiments, the cellulose gel is filtered through mesh pores size in the range of 300-500 MESH (US STANDARD SIZE), preferably 400 MESH (US STANDARD SIZE) or 25-50 MICRON OPENINGS. As will be appreciated by one of skill in the art, the filtering removes unmodified fibers which may block the syringe nozzle, discussed below.

In some embodiments, although this is not required, following filtration, the cellulose gel is degassed under vacuum. The degassing may be done at room temperature for 1 to 60 min.

The acidic conditions may be carried out at any suitable temperature, for example at a temperature range of between +5° C. to +60° C.

Regeneration of cellulose in an acid-containing bath is required. While any suitable acid can be used, $H_2SO_4$ is preferred. In acidic conditions, the NaOH is neutralized. This creates two important effects: 1) the cellulose hydrogen bonding is restored which helps increase yarn strength; and 2) salt such as $Na_2SO_4$ is formed which aids the cellulose precipitation/coagulation process. The acid range is 10-20% wt of the cellulose; salt ($Na_2SO_4/ZnSO_4$) range: 5-25%.

Although our textile fibres were produced using bleached softwood kraft pulp as opposed to dissolving pulp normally used as feedstock for rayon production, they did resemble cotton fibres. This can be explained by the fact that the yarns are produced from bleached kraft softwood pulp that contains crystalline cellulose I (naturally occurring) whereas in rayon, following cellulose regeneration, cellulose I is concerted to cellulose II. The difference between the two types of cellulose is: 1) in cellulose II, hydrogen bonding is irregular and incomplete compared to cellulose I; 2) the length and width of the crystalline regions in cellulose II is irregular compared to cellulose I. Similar to pulp fibers, cotton fibers are composed of cellulose I. Therefore, with our method, it is possible to produce textile that feels and behaves more like cotton than rayon.

As will be apparent to one of skill in the art, the properties of our textile fibers can be varied depending on the extent of chemical crosslinking, or by the addition of other reagents such as plasticizers or by using a different starting material, such as non-modified pulp fibers. For example, 1) increased crosslinking leads to higher yarn strength; 2) higher % of plasticizers in yarns improves the yarn flexibility; 3) increased fiber concentration in yarns will decrease both the yarn strength and flexibility. Therefore, yarn properties are optimized in terms of the above three factors depending on the intended use.

Furthermore, the use of bleached kraft pulp instead of dissolving pulp can bring about economic benefits whereas the replacement of the toxic $CS_2$—based cellulose dissolution process with our novel aqueous-based process will provide environmental advantages.

The invention will now be further described and elucidated by way of examples; however, the invention is not necessarily limited by the examples.

EXAMPLES

An experimental setup for oxidation reaction, making gel and extrusion of yarns was developed. Continuous filaments were produced using a syringe pump with a modified needle employing a new drying technique.

The oxidation was carried out in aqueous media using a glass beaker with overhead stirrer under the following reaction conditions: bleached softwood kraft pulp (10.0 g), sodium metaperiodate (13.6 g; 100 mole % based on moles of AGU unit) and sodium chloride (29 g; 0.5 N in the overall solution) were added in 500 mL deionised water. The reaction mixture was gently stirred at room temperature in the dark for 12 h. After this time, the modified pulp was filtered out and washed with deionized water repeatedly. The aldehyde content of the modified cellulose was around 1.6 mmol/g cellulose. We used the hydroxylamine-hydrochloride ($NH_2OH.HCl$) standard titration method to calculate the aldehyde groups, according to which the HCl released from the reaction of aldehydes and $NH_2OH.HCl$ is determined by titration with NaOH solution of known normality.

Five (5) g modified cellulose wad dispersed in 50 g solvent (weight ratio of NaOH and H2O is 6:94) in a stainless steel vessel and precooled to <0° C., followed by vigorous stirring for 5 min at room temperature. One (1) g of chitosan powder was immersed into 24 mL of 10 wt % NaOH in an ice bath for about 6 h. After being stirred and frozen at −5° C. for 12 h, the resultant product was thawed and stirred extensively at room temperature. Thereafter 6.25 g of chitosan solution was mixed with the cellulose solution to obtain a mixture solution containing 5 wt % of chitosan (5% chitosan w/w cellulose). Subsequently, the resultant solution was stirred at room temperature for 30 min which led to formation of a dope (gel). The dope can also be formed at room temperature, but more homogeneous gels are formed at lower temperatures. The dope was filtered through 400 pores meshes and then degassed under vacuumed for 5 min at room temperature.

The dope was transferred into a syringe equipped with a needle and extruded in the form of yarn in a coagulation bath containing a 12.5 wt % $H_2SO_4$/10 wt % $Na_2SO_4$ aqueous solution. Extrusion was carried out at room temperature at a constant flow rate of 1 ml/min. Hydrochloric acid or mixture of sulphuric acid, sodium sulphate and zinc sulphate typically used in rayon production could also be used.

The dope in the coagulation bath solidified upon contact with the acid and could be drawn into a washing water bath where the excess of sodium hydroxide or sulphuric acid or their salt is removed. After spinning and thorough washing, the yarns were dried in air at room temperature. The properties of the extruded threads depend on: 1) the crosslinking density, 2) the presence of plasticizers and 3) fiber concentration.

Increased crosslinking leads to higher yarn strength; 2) higher % of plasticizers in yarns improves the yarn flexibility; 3) increased fiber concentration in yarns will decrease both the yarn strength and flexibility. Therefore, yarn properties should be optimized in terms of the above three factors.

Tensile strengths were measured using a hand tensile machine. The tenacity of our yarns was 0.95 (average value of 4 different measurements). Table 1 compares the tenacity of our yarn to that of rayon and cotton fibers. The water uptake (absorbent) value of our novel yarn is around 1.5-2 g water/g yarn which is lower than rayon fibers and slightly higher than cotton fibers (Table 2).

Tenacity is the most important property of yarns that is indicative of their strength. Tenacity of our yarns is comparable or exceeds that of rayon, as evident from Table 1. We can produce yarns with tenacity in the range 0.5-3.0 cN/dtex. In comparison, the rayon tenacity ranges from 0.5 to 2.5 cN/dtex.

TABLE 1

| Yarn Comparison (Tensile) | | |
|---|---|---|
| Property | Our yarns (not drawn) | Rayon (not drawn) |
| Tenacity (cN/dtex) | 0.95 (experimental) | 0.90 (literature) |

TABLE 2

| Water Uptake Comparison | |
|---|---|
| Sample | Water uptake (g water/g yarn) |
| Our yarns | 1.5-2.0 |
| Rayon | 2-4 |
| Cotton | 1.1-1.2 |

Water absorbency is the amount of water uptake (g) per g of yarn. The lower the water absorbency, the better the yarn quality for textile applications. The water absorbency of our yarns is up to two-fold lower than that of rayon which is significant (Table 2). We have observed water absorbency of 1 to 10 g $H_2O$/g fiber, although a range of 1.5-2.0 is more typical.

The scope of the claims should not be limited by the preferred embodiments set forth in the examples but should be given the broadest interpretation consistent with the description as a whole.

The invention claimed is:

1. A method of generating a textile yarn comprising:

subjecting a quantity of wood pulp to periodate oxidation;

recovering dialdehyde cellulose;

dissolving the dialdehyde cellulose in sodium hydroxide;

adding an amine-containing compound to the dissolved dialdehyde cellulose;

recovering a cellulose gel;

filtering the cellulose gel;

extruding the filtered cellulose gel into yarn in an acid-containing bath; and washing the yarn.

2. The method according to claim 1 wherein the dialdehyde cellulose has a degree of substitution of 0.1 to 0.5.

3. The method according to claim 1 wherein the sodium hydroxide concentration range is 5-20 wt %.

4. The method according to claim 1 wherein the dialdehyde cellulose concentration is 5 to 12 w/w %.

5. The method according to claim 1 wherein the cellulose gel is filtered through pores of 300-500 MESH.

6. The method according to claim 1 wherein following filtration, the cellulose gel is degassed under vacuum.

7. The method according to claim 1 wherein the yarn is extruded at a temperature range of between +5° C. to +60° C.

8. The method according to claim 1 wherein the amine-containing compound is chitosan.

9. The method according to claim 8 wherein the chitosan is: 1-15 wt % of cellulose.

10. The method according to claim 9 wherein the chitosan is 5-7 wt % of cellulose.

11. The method according to claim 1 wherein acid range in the acid-containing bath is 10-20% wt of cellulose.

12. The method according to claim 1 wherein the acid-containing bath includes $H_2SO_4$.

* * * * *